US008677559B2

(12) United States Patent
Hollis

(10) Patent No.: US 8,677,559 B2
(45) Date of Patent: Mar. 25, 2014

(54) VACUUM ASSISTED FUR REMOVAL TOOL

(75) Inventor: Robert R. Hollis, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 311 days.

(21) Appl. No.: 13/315,157

(22) Filed: Dec. 8, 2011

(65) Prior Publication Data

US 2013/0145576 A1 Jun. 13, 2013

(51) Int. Cl.

| | |
|---|---|
| ***A47L 9/06*** | (2006.01) |
| ***A46B 17/06*** | (2006.01) |
| *A46B 7/04* | (2006.01) |

(52) U.S. Cl.

CPC ..... *A47L 9/0673* (2013.01); *A46B 7/044* (2013.01)
USPC ..... 15/400; 15/38

(58) Field of Classification Search

CPC ..... A46B 5/0095; A46B 7/044; A47L 9/06; A47L 9/0633; A47L 9/0653; A47L 9/0673
USPC ..... 15/38, 398, 400
IPC ..... A46B 17/06; A47L 9/06
See application file for complete search history.

(56) References Cited

U.S. PATENT DOCUMENTS

| | | | | |
|---|---|---|---|---|
| 2,674,002 | A * | 4/1954 | White | 15/365 |
| 4,045,840 | A | 9/1977 | Johansson | |
| 4,864,681 | A | 9/1989 | Hult et al. | |
| 5,184,372 | A | 2/1993 | Mache | |
| 5,230,303 | A | 7/1993 | Rubino | |
| 5,419,007 | A | 5/1995 | Hult et al. | |
| 5,502,873 | A | 4/1996 | Hogan | |
| 5,706,550 | A | 1/1998 | Holsten et al. | |
| D392,780 | S | 3/1998 | Holsten et al. | |
| 6,842,942 | B2 | 1/2005 | Morgan et al. | |
| 7,661,175 | B2 | 2/2010 | Hollis | |
| 7,721,372 | B2 | 5/2010 | Knopow et al. | |
| 7,870,639 | B2 * | 1/2011 | Thomas | 15/322 |
| 8,011,050 | B2 | 9/2011 | Knopow | |
| 2005/0120511 | A1 | 6/2005 | Pedersen | |
| 2005/0262662 | A1 | 12/2005 | Roschi et al. | |
| 2006/0248680 | A1 | 11/2006 | Heidenga et al. | |
| 2010/0236017 | A1 | 9/2010 | Krebs | |

FOREIGN PATENT DOCUMENTS

| | | | |
|---|---|---|---|
| DE | 2 100 465 | A1 | 7/1972 |

* cited by examiner

*Primary Examiner* — David Redding
(74) *Attorney, Agent, or Firm* — Sutton McAughan Deaver, PLLC

(57) ABSTRACT

Described is a self-cleaning vacuum cleaner accessory apparatus, method, and system including a tubular element, a nozzle, and a nozzle housing that can include at least one nozzle housing notch. The apparatus can further include a bristle plate coupled to the nozzle housing. The bristle plate can include at least one bristle and at least one tabular release element to control the movement of at least one bristle plate tab. The at least one bristle plate tab can be coupled to, or decoupled from, the at least one nozzle housing notch to either permit or prohibit the bristle plate's movement with respect to the nozzle housing. The bristle plate can further include a pivot for rotating the bristle plate to invert the at least one bristle's orientation. Once inverted, airflow from a vacuum can remove debris from the bristles before returning the bristle plate to its original orientation.

18 Claims, 6 Drawing Sheets

VACUUM ASSISTED FUR REMOVAL TOOL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to vacuum cleaner accessory tools. In one of the aspects, the invention relates specifically to an accessory tool for use with a vacuum appliance, wherein the accessory tool is adapted to remove pet hair and fur from carpets, couches, drapes, curtains, and other fabric surfaces. In further aspects, the invention relates to a vacuum accessory tool that includes a means for self-cleaning of the brush, thereby resisting clogging and binding of the vacuum tool by pet hair during use.

2. Description of the Related Art

Pet ownership in the United States is increasingly common, with many of these pets being dogs and cats. However, many of these pets tend to shed hair, which collects on carpets, furniture, and other areas of the home, as well as on clothing. This means that pet owners are then faced with the difficult task of removing pet hair from numerous surfaces throughout the household; a task made more difficult in that pet hair and similar debris can be relatively small or fine in nature, thus rendering it difficult to collect, even with conventional vacuum cleaners.

Often, ordinary vacuum cleaner attachments, even those touted as suitable for such specific uses as pet hair removal, do a poor job of removing pet hair, mostly because the pet hair becomes tangled or even interwoven with the fabric it is attached to. This means that the vacuum airflow alone is often insufficient to remove the pet hair from the article. Further, vacuum cleaners employing rotating or otherwise moving parts, such as rotatable agitators and air turbines, can easily accumulate pet hair or other similar debris at or in those moving parts. This is because the moving parts are often in the suction path of the vacuum, thereby impeding the operation and effectiveness of the vacuum cleaner.

One common solution to these problems has been to use a dedicated pet brush with rubber or rubberized bristles. These bristles are often shaped or sized so as to allow the bristles to more efficiently "grab" the hair, aiding in its removal from the fabric or article being cleaned. However, these types of vacuum accessory brushes accumulate collected hair, and then the brushes themselves have to be cleaned. This task is not only time consuming, but can be disagreeable in that it involves the user "picking" the hair out of the bristles manually. A variety of other approaches have also been described in an attempt to address this issue.

For example, U.S. Pat. No. 6,711,777 to Frederick, et al. describes a turbine powered vacuum cleaner tool wherein a nozzle body encloses an agitator located adjacent an elongated suction inlet opening. A turbine rotor is rotatably connected to the nozzle body and operatively connected to the agitator so that airflow generated by a remote suction source flows through the nozzle body and rotates the agitator.

U.S. Pat. No. 4,042,995 to Varon describes a brush for removing animal hair from carpeting and upholstery comprising a plurality of flexible bristles composed of polymeric materials that create an electrostatic charge to attract the animal hair to the bristles. As specifically described, a field of smooth tapered polyethylene bristles extend down from a head attached to a broom handle. The bristles are pulled through carpeting to pick up animal hair. The density of bristles at the trailing edge is greater than elsewhere, and the bristles are arranged in a saw-tooth leading edge pattern.

U.S. Pat. No. 3,574,885 to Jones describes a brush having a base member, a plurality of flexible plastic bristles mounted to the base member, and a tubular adapter for connection with a vacuum cleaner to remove loose hair dislodged while brushing an animal. In an alternate embodiment, the brush comprises a mitt secured to a flexible base member to receive the hand of the operator.

German Patent Application Publication No. 2,100,465 to Schwab describes a floor accessory tool which is a floor sweeper apparatus with a horizontal brush driven by the rotation of ground-engaging wheels. Bristle pads are arranged on both sides of the brush and have bristles directed toward the rotating horizontal brush to aid in directing debris into the vacuum inlet of the tool.

These prior art solutions have several drawbacks for one or more of the reasons discussed above. For example, although each of these prior art solutions aim to remove debris from various surfaces, the solutions do not address eliminating the need to manually clean the vacuum or its attachments. It is therefore desirable for individuals to have a better solution for vacuuming pet hair and fur from carpets, couches, drapes, curtains, and the like while obviating the drawbacks associated with the prior art solutions discussed above. Accordingly, the inventions disclosed and taught herein are directed to an apparatus, method, and system for a self-cleaning vacuum cleaner accessory that overcomes the problems set forth above.

BRIEF SUMMARY OF THE INVENTION

The present invention is directed to a self-cleaning vacuum cleaner accessory apparatus ("SCVCAA") that can be coupled to a vacuum cleaner or other cleaning device employing airflow suction for the removal of debris such as pet hair, fur, or the like on various surfaces or fabrics.

The disclosure provides a SCVCAA that can include a tubular element adapted for releasable attachment to, or detachment from, a vacuum or other cleaning device. The SCVCAA can include a nozzle operably coupled to a nozzle housing. The nozzle housing can include at least one nozzle housing notch. The SCVCAA can include a bristle plate that can further include at least one bristle and a pivot. The at least one bristle can extend outwardly from the nozzle. The bristle plate can be adapted to couple to the nozzle housing in order to facilitate the bristle plate's movement with respect to the nozzle housing.

The disclosure also provides a SCVCAA including a bristle plate that can include at least one tabular release element and at least one bristle plate tab. The at least one tabular release element can be adapted to control the movement of the at least one bristle plate tab. The at least one nozzle housing notch can be adapted to receive the at least one bristle plate tab. The at least one bristle plate tab can be coupled to the at least one nozzle housing notch in order to prohibit the bristle plate's ability to move with respect to the nozzle housing.

The disclosure also provides a SCVCAA that can include a bristle plate further including at least one tabular release element that can decouple the at least one bristle plate tab from at least one nozzle housing notch. When decoupled, the bristle plate can be adapted to move with respect to the nozzle housing by sliding away from the nozzle housing along a horizontal axis or any other axis extending to or from the nozzle housing.

The disclosure also provides a SCVCAA that can include a pivot adapted to rotate the position of the bristle plate with respect to the nozzle housing. The pivot is adapted to rotate the position of the bristle plate to configure the at least one bristle to extend inwardly toward the nozzle.

The disclosure also provides a method of making a SCVCAA that can include providing a vacuum cleaner accessory. The vacuum cleaner accessory can include a nozzle, a nozzle housing, a bristle plate, and at least one bristle. The at least one bristle can extend outwardly from the nozzle. Furthermore, the bristle plate can include a pivot. The method of making a SCVCAA can include adjusting the position of the bristle plate with respect to the nozzle housing.

The disclosure also provides a method of making a SCVCAA that can include a step of coupling the bristle plate to the nozzle housing with at least one bristle plate tab. The disclosure also provides a step of decoupling at least one bristle plate tab from at least one nozzle housing notch in order to permit the bristle plate's movement with respect to the nozzle housing. The decoupling step can be performed by adjusting the position of a tabular release element. The disclosure can further include a step of adjusting the position of the bristle plate by sliding the bristle plate away from the nozzle housing. The step of adjusting the position of the bristle plate can include sliding the bristle plate along a horizontal axis of the nozzle housing to an opposite edge of the nozzle housing.

The disclosure also provides a method of making a SCVCAA that can include a step of rotating the position of the bristle plate with respect to the nozzle housing to configure the at least one bristle to extend inwardly toward the nozzle. The rotating step can include rotating the bristle plate 180 degrees in order to invert the at least one bristle's orientation with respect to the nozzle. The method can include a step of coupling the bristle plate to the nozzle housing with at least one bristle plate tab once the bristle plate is rotated. The method can further include a step of removing debris from the at least one bristle. The method can include a step of decoupling the at least one bristle plate tab from the at least one nozzle housing notch. The disclosure also provides the step of rotating the position of the bristle plate with respect to the nozzle housing to configure the at least one bristle to extend outwardly away from the nozzle. The method can include a step of sliding the bristle plate along a horizontal axis of the nozzle housing to an opposite edge of the nozzle housing. The method can further include the step coupling the at least one bristle plate tab to the at least one nozzle housing notch to prohibit the bristle plate's movement with respect to the nozzle housing.

The disclosure also provides a self-cleaning vacuum cleaner accessory system that can include a vacuum, a vacuum hose, a vacuum inlet, and a vacuum cleaner accessory apparatus. The vacuum cleaner accessory apparatus can include a tubular element, a nozzle operably coupled to a nozzle housing, and a bristle plate. The tubular element can be adapted to be coupled to the vacuum. The bristle plate can further include at least one bristle and a pivot. The at least one bristle can extend outwardly from the nozzle. The bristle plate can be further adapted to be coupled to the nozzle housing to facilitate the bristle plate's movement with respect to the nozzle housing.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
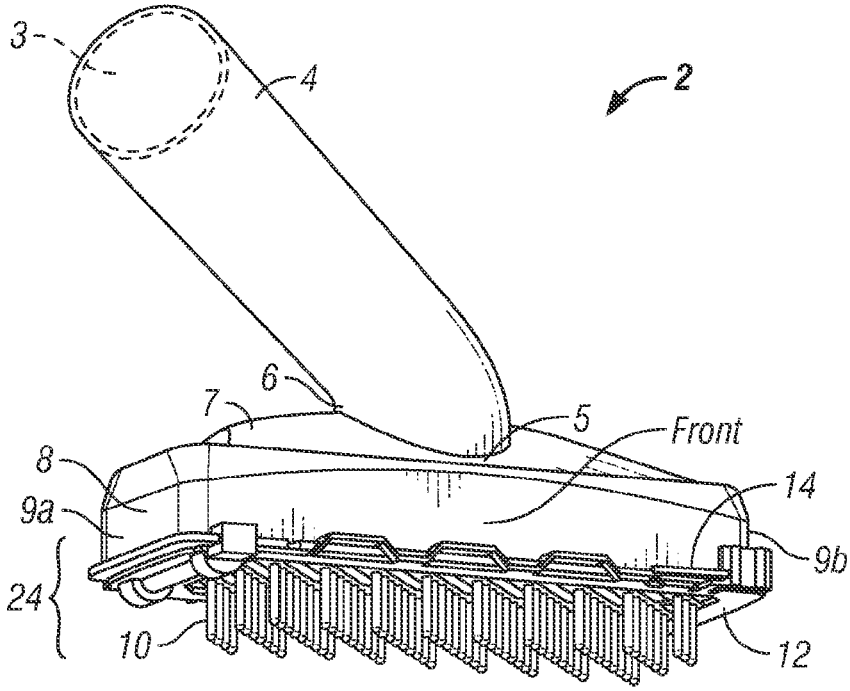
FIG. 1 illustrates a isometric schematic view of a first embodiment of the self-cleaning vacuum cleaner accessory apparatus.

While the inventions disclosed herein are susceptible to various modifications and alternative forms, only a few specific embodiments have been shown by way of example in the drawings and are described in detail below. The Figures and detailed descriptions of these specific embodiments are not intended to limit the breadth or scope of the inventive concepts or the appended claims in any manner. Rather, the Figures and detailed written descriptions are provided to illustrate the inventive concepts to a person of ordinary skill in the art and to enable such person to make and use the inventive concepts.

DETAILED DESCRIPTION

Applicant has created a self-cleaning vacuum cleaner accessory apparatus, method, and system including a tubular element, a nozzle, and a nozzle housing including at least one nozzle housing notch. The apparatus can further include a bristle plate coupled to the nozzle housing. The bristle plate can include at least one bristle and can further include at least one tabular release element that can control the coupling of at least one bristle plate tab to the at least one nozzle housing notch. The at least one bristle plate tab can be coupled to, or decoupled from, the at least one nozzle housing notch in order to either permit or prohibit the bristle plate's movement with respect to the nozzle housing. The bristle plate can further include a pivot for rotating the bristle plate in order to invert the at least one bristle's orientation. Once inverted, airflow from a vacuum can self-clean the at least one bristle by removing debris from the at least one bristle before the bristle plate is returned to its original orientation.

Figure 8:
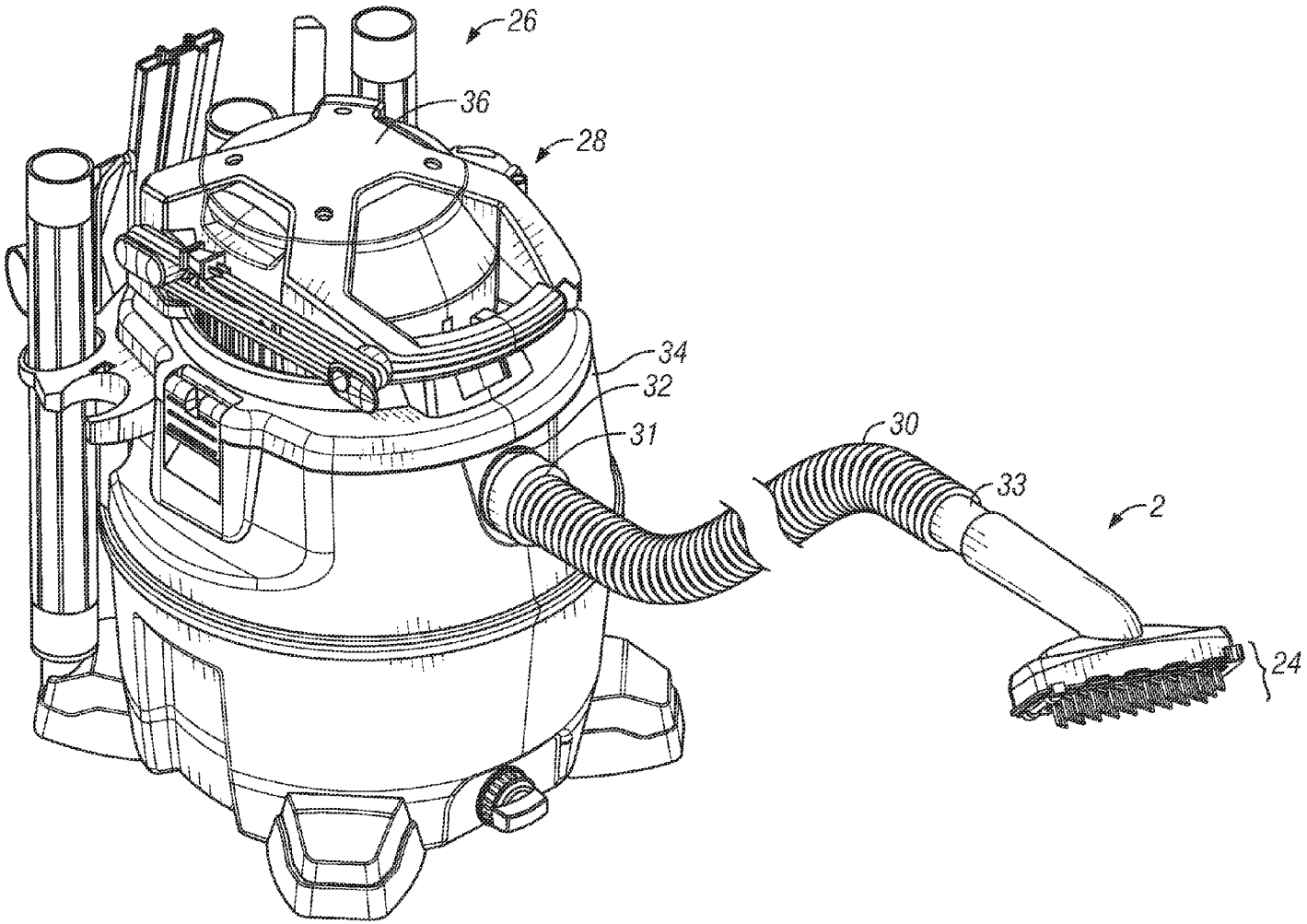
FIG. 8 illustrates a front schematic view of a first embodiment of the self-cleaning vacuum cleaner accessory system.

Turning now to the figures, FIG. 1 is an isometric schematic view of a first embodiment of the self-cleaning vacuum cleaner accessory apparatus (SCVCAA) 2. The SCVCAA 2 can include a tubular element 4 and a nozzle 6. The tubular element 4 can be adapted for releasable attachment to, or detachment from, a vacuum 28 as shown in FIG. 8. The apparatus 2 further includes a front side 7*a*, an opposite rear side 7*b*, a right side 9*a*, an opposite left side 9*b*, and a top cover portion 5 atop the nozzle housing 8 of nozzle 6. Each of the sides has a bottom edge that contacts the bristle plate 12. The tubular element 4 as shown includes a first end having a tube-receiving orifice 3, and an opposite end that is be operably coupled to, or integrally formed with, nozzle housing 8 of the nozzle 6. The first end of the tubular element 4 can slide over or into a vacuum hose or similar vacuum-related tool for connection to a vacuum appliance, such that vacuum air flow communication is maintained through the apparatus 2, up and through the orifice 3. The SCVCAA 2 can also include a bristle plate 12 adapted to be coupled to the nozzle housing 8 to facilitate the bristle plate's 12 movement with respect to the nozzle housing 8. The bristle plate 12 can include at least one, and preferably a plurality of, bristles 10. The bristle plate 12 can further include a pivot 16. Furthermore, the bristle plate 12 can include at least one bristle plate tab 14 adapted to be coupled to the nozzle housing 8. The at least one bristle plate tab 14 can be further adapted to control the movement of the bristle plate 12 with respect to the nozzle housing 8.

In one embodiment, the at least one bristle 10 extends outwardly from the nozzle 6. As an exemplary, non-limiting illustrative embodiment, the at least one bristle 10 can extend orthogonally with respect to the bristle plate 12. Alternatively, the at least one bristle 10 can extend outwardly from the bristle plate 12 at a non-orthogonal angle with respect to the bristle plate 12. In an embodiment where the at least one bristle 10 comprises at least two bristles, each of the bristles can either extend at a uniform angle with respect to the bristle plate 12, or at non-uniform angles with respect to the bristle plate 12.

In one embodiment, the at least one bristle 10 can be made of an overmolded rubber. In another embodiment, the at least one bristle 10 can be made of natural or synthetic rubber, synthetic or semi-synthetic organic amorphous solids, plastic, or polymers. In another embodiment, the at least one bristle 10 can be made from a combination of one or more of the foregoing materials.

In another embodiment, the at least one bristle 10 can be arranged in a staggered configuration to configure the at least one bristle 10 to align along a forty-five degree angle with respect to the bristle plate 12. Furthermore, the at least one bristle 10 can be arranged to configure each bristle to be positioned equidistant from its neighboring bristle. Alternatively, the at least one bristle 10 can be arranged in a configuration where one or more bristles are of varying distance among each bristle's nearest neighboring bristle. In one embodiment, the at least one bristle 10 can be arranged along an orthogonal pattern to configure two or more bristles of the at least one bristle 10 in orthogonally arranged rows and columns with respect to the bristle plate 12. In another embodiment, the at least one bristle 10 can comprise two or more bristles arranged in a random configuration.

In another embodiment, the at least one bristle 10 can comprise two or more bristles arranged to create a coplanar configuration at the terminating edge farthest from the bristle plate 12. Alternatively, the at least one bristle 10 can comprise two or more bristles arranged to create a configuration where the bristles' terminating edges farthest from the bristle plate 12 form a non-coplanar orientation with respect to at least one other bristle.

In one embodiment, the at least one bristle 10 can have a high coefficient of friction that can be used to more easily secure debris and aid in debris removal from various types of fabric. For example, in an exemplary and non-limiting illustrative embodiment, the one or more bristle 10 can have a coefficient of friction approximately equal to that of rubber or rubberized bristles. In other embodiments, the one or more bristle's 10 coefficient of friction can be greater than, or less than, that of rubber or rubberized bristles.

Figure 2:
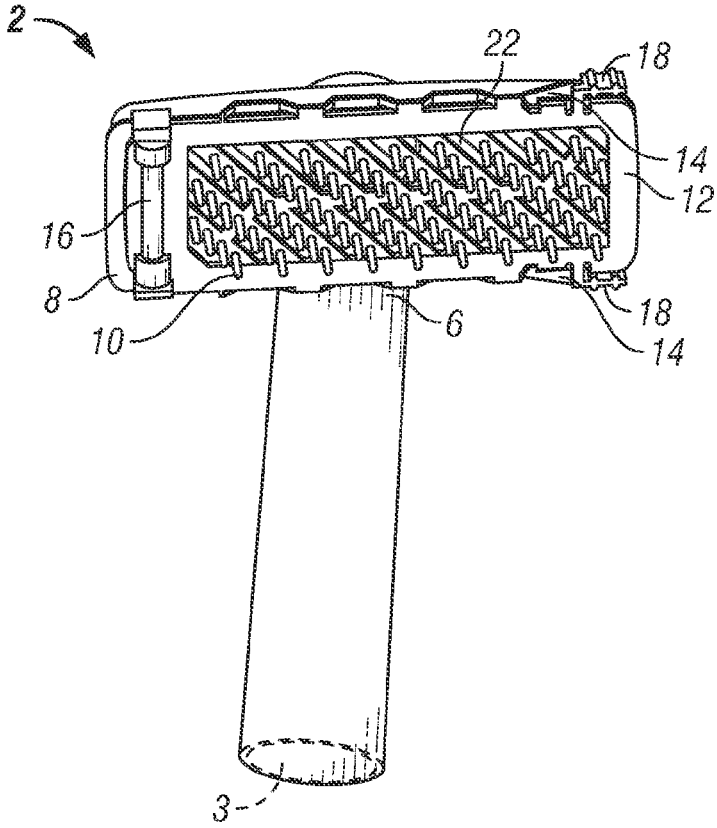
FIG. 2 illustrates a bottom schematic view of a first embodiment of the self-cleaning vacuum cleaner accessory apparatus depicted in FIG. 1.

FIG. 2 is a bottom schematic view of a first embodiment of the self-cleaning vacuum cleaner accessory apparatus (SCVCAA) 2 depicted in FIG. 1. The SCVCAA can include a nozzle 6, a nozzle housing 8, and bristle plate 12. The bristle plate 12 can include at least one bristle plate tab 14 and a pivot 16. The bristle plate 12 can further include at least one tabular release element 18. The at least one tabular release element 18 can be adapted to control the movement of the at least one bristle plate tab 14. The pivot 16 can be adapted to rotate the position of the bristle plate 12 with respect to the nozzle housing 8.

In an exemplary and non-limiting illustrative embodiment, the at least one tabular release element 18 can comprise two or more tabular release elements 18 that form grasp points that extend outwardly from the bristle plate 12. In this embodiment, each of the tabular release elements 18 can be located on either the left or right side of the bristle plate 12 with respect to nozzle 6. In this embodiment, the tabular release elements 18 can further be located on opposite sides of the leading and trailing edge of the bristle plate 12 with respect to the nozzle 6. In this configuration, a user may grasp both tabular release elements 18 at the same time with the same hand in order to control the movement of the at least one bristle plate tab 14.

In another embodiment, the at least one tabular release element 18 can be located at other various locations on the bristle plate 12 to accommodate both left and right handed users. In one exemplary, non-limiting illustrative embodiment, the at least one tabular release element 18 can be located on a bottom portion of the bristle plate 12. Further, the at least one tabular release element 18 can be located on the left or right edges of the bristle plate 12 with respect to the nozzle 6. In one embodiment, the at least one tabular release element 18 can be positioned to remain flush with the bristle plate 12, extend outwardly from the bristle plate 12, or extend inwardly from the bristle plate 12.

In one embodiment, the pivot 16 can be adapted to rotate the position of the bristle plate 12 to configure the at least one bristle 10 to extend inwardly toward the nozzle 6. As an exemplary, non-limiting illustrative embodiment, the pivot 16 can be adapted to rotate the bristle plate 12 180 degrees with respect to the nozzle housing 8 to configure the at least one bristle 10 to extend orthogonally toward the nozzle 6 with respect to the bristle plate 12. In one embodiment, the at least one bristle 10 can extend inwardly toward the nozzle 6 at a non-orthogonal angle with respect to the bristle plate 12. In an embodiment where the at least one bristle 10 comprises at least two bristles, each of the bristles can either extend at a uniform angle with respect to the bristle plate 12, or at non-uniform angles with respect to the bristle plate 12.

The self-cleaning vacuum cleaner accessory apparatus (SCVCAA) 2 half-way through its self-cleaning configuration. The SCVCAA 2 can include a tubular element 4, a nozzle 6, a nozzle housing 8, and bristle plate 12. The bristle plate 12 can include at least one bristle 10, at least one bristle plate tab 14, a pivot 16, and at least one tabular release element 18. The bristle plate 12 can be adapted to slide away from the nozzle housing 8. The nozzle housing 8 can further include at least one nozzle housing notch 20. The at least one nozzle housing notch 20 can be adapted to receive the at least one bristle plate tab 14. The at least one bristle plate tab 14 can be operably coupled to, or decoupled from, the at least one nozzle housing notch 20 to either permit or prohibit the bristle plate's 12 movement with respect to the nozzle housing 8. In one embodiment, the at least one bristle plate tab 14, when coupled to the at least one nozzle housing notch 20, can lock the bristle plate 12 to the nozzle housing 8.

Furthermore, the bristle plate 12 can be coupled to the nozzle housing 8, and the at least one bristle plate tabs 14 can be coupled to the at least one housing notch 20. By coupling the at least one bristle pate tab 14 and the at least one housing notch 20, the bristle plate's 12 ability to move with respect to the nozzle housing 6 can be prohibited.

In an exemplary, non-limiting illustrative embodiment, the at least one tabular release element 18 can be adapted to control the movement of the at least one bristle plate tab 14. In this illustrative embodiment, a user can grasp the at least one tabular release element 18 to decouple the at least one bristle plate tab 14 from the at least one nozzle housing notch 20. By decoupling the at least one bristle plate tab 14 from the at least one nozzle housing notch 20, the user can freely move the bristle plate 12 with respect to the nozzle housing 8 along an axis relative to the pivot 16. In one embodiment, a user can move the bristle plate 12 along a perpendicular axis relative to the pivot 16. By aligning the at least one bristle plate tab 14 and the at least one nozzle housing notch 20, a user can couple the at least one bristle plate tab 14 to the at least one nozzle housing notch 20 by releasing the at least one tabular release element 18. The at least one bristle plate tab 14 can couple to the at least one nozzle housing notch 20 in a locking fashion, thereby prohibiting the bristle plate's 12 movement.

In one embodiment, the pivot 16 can be located on either the left or right side of the bristle plate 12 with respect to the nozzle housing 8. In one embodiment, the bristle plate 10 can move with respect to the nozzle housing 8 by sliding away from the nozzle housing 8 along a horizontal axis of the nozzle housing 8. In another embodiment, the pivot 16 can be located on either the upper or lower edge of the bristle plate 12 with respect to the nozzle housing 8. In another embodiment, the bristle plate 10 can slide away from the nozzle housing 8 along a vertical axis of the nozzle housing 8. In another embodiment, the bristle plate 10 can move either along a horizontal axis, a vertical axis, or a combination of each axis irrespective of the position of the pivot 16. In one embodiment, the pivot 16 can be located in a position other than along an edge of the bristle plate 12.

In an exemplary, non-limiting illustrative embodiment, the bristle plate 12 can slide along an axis until the pivot 16 is positioned at the opposite edge of the nozzle housing 8. In this embodiment, the bristle plate 12 can be coupled to the nozzle housing 8 to prevent the bristle plate 12 from being decoupled from the nozzle housing 8 once the pivot 16 is positioned at the opposite end of the nozzle housing 8. In another embodiment, the bristle plate 12 can be decoupled from the nozzle housing 8 once the pivot 16 is positioned at the opposite end of the nozzle housing 8.

In an exemplary, non-limiting illustrative embodiment, the at least one nozzle housing notch 20 can comprise a notch, slit, indentation, or other cut away portion of the nozzle housing 6. In another embodiment, the at least one nozzle housing notch 20 can comprise a notch, slit, indentation or other cut away portion coupled to the nozzle housing 8. In an exemplary, non-limiting illustrative embodiment, the at least one nozzle housing notch 20 can comprise at least two notches located on opposite sides of the leading and trailing edges of the nozzle housing 8. In another exemplary, non-limiting illustrative embodiment, the at least one nozzle housing notch 20 can be located at other locations on the nozzle housing 8, such as the left, right, top, or bottom edges of the nozzle housing 8. In one embodiment, the at least one nozzle housing notch 20 can be located in position other than along an edge of the bristle plate 12.

Figure 3:
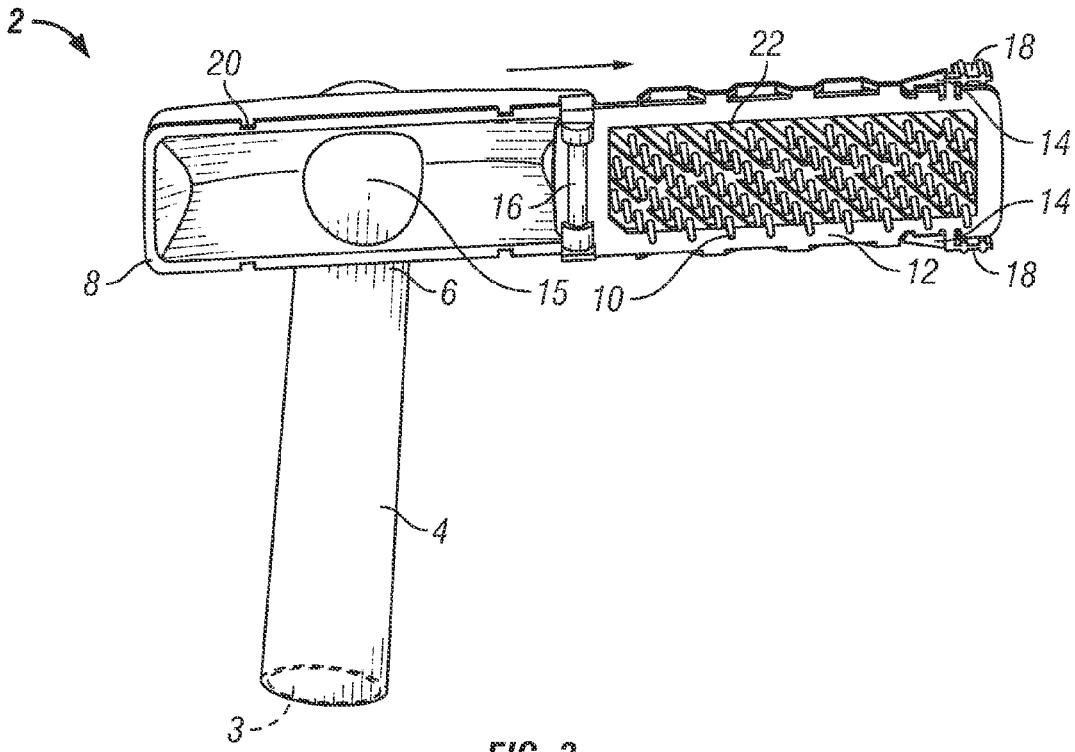
FIG. 3 illustrates a another bottom schematic view of a first embodiment of the self-cleaning vacuum cleaner accessory apparatus half-way through its self-cleaning configuration.
Figure 4:
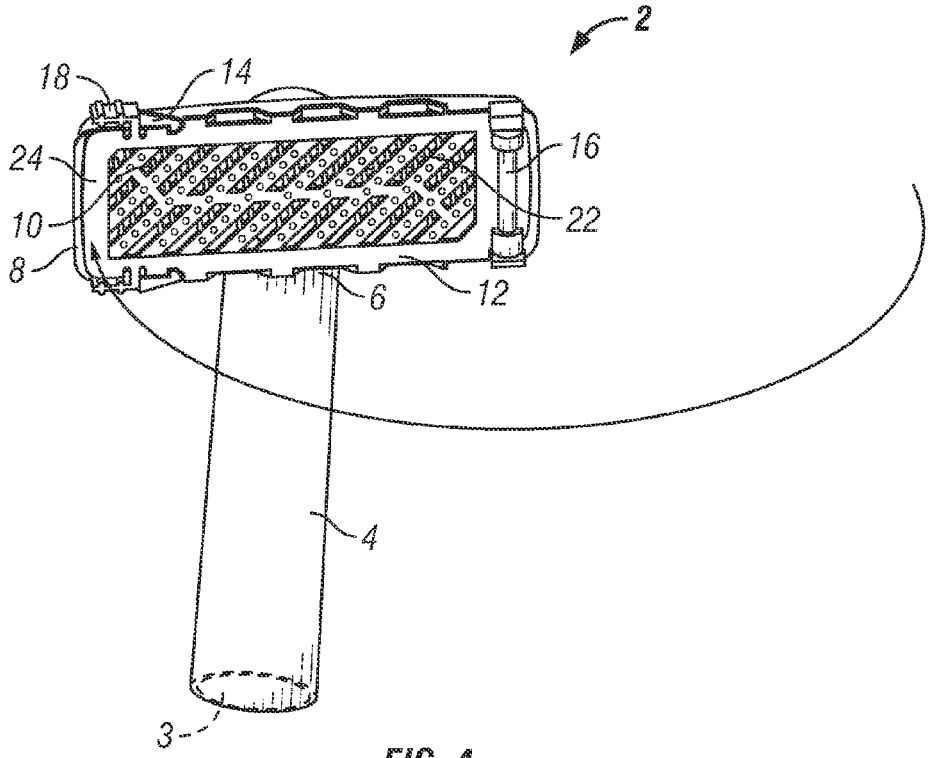
FIG. 4 illustrates another bottom schematic view of a first embodiment of the self-cleaning vacuum cleaner accessory apparatus in its self-cleaning configuration.

FIG. 4 is a another bottom schematic view of a first embodiment of the self-cleaning vacuum cleaner accessory apparatus (SCVCAA) 2 in its self-cleaning configuration. The SCVCAA 2 can include a tubular element 4, a nozzle 6, a nozzle housing 8, and bristle plate 12. The bristle plate 12 can include at least one bristle plate tab 14 and at least one tabular release element 18. The bristle plate 12 can further include a pivot 16. In this configuration, the pivot 16 can be adapted to rotate the position of the bristle plate 12 with respect to the nozzle housing 8. By rotating the position of the bristle plate 12 along an axis of the pivot 16, the position of the bristle plate 12 can be inverted to reverse the orientation of the at least one bristle 10. By inverting the bristle plate's 12 position, the at least one bristle 10 can extend inwardly toward the nozzle 6. Furthermore, the at least one bristle plate tab 14 can be coupled to the at least one nozzle housing notch 20 as shown in FIG. 3 to prevent further movement of the bristle plate 12 after inverting the position of the bristle plate 12. In an exemplary, non-limiting illustrative embodiment, the bristle plate 12 can be inverted back to its original orientation by first decoupling the at least one bristle plate tab 14 from the at least one nozzle housing notch 20.

The bristle plate 12 can also include at least one bristle plate slit 22. The at least one bristle plate slit 22 can allow air to flow freely through at least a portion of the bristle plate 12. In an exemplary, non-limiting illustrative embodiment, the at least one bristle plate slit 22 can comprise two or more slits of equal size arranged at a forty-five degree angle in between staggered rows of bristles. In another embodiment, the at least one bristle plate slit 22 can comprise two or more slits of varying shapes and sizes. In another embodiment, the at least one bristle plate slit 22 can comprise two or more slits arranged in an arbitrary pattern on the bristle plate 12. In one embodiment, the bristle plate 12, the at least one bristle 10, and the at least one bristle plate slit 22 can form a brush 24.

The pivot 16 can be adapted to rotate the bristle plate 12 over a range of varying degrees with respect to the nozzle housing 8. In an exemplary, non-limiting illustrative embodiment, the bristle plate 12 can rotate 180 degrees with respect to the nozzle housing 8 to invert the bristle plate 12. In another embodiment, the pivot 16 can rotate either more than, or less than, 180 degrees before the SCVCAA 2 is engaged in a self-cleaning operation.

Figure 5:
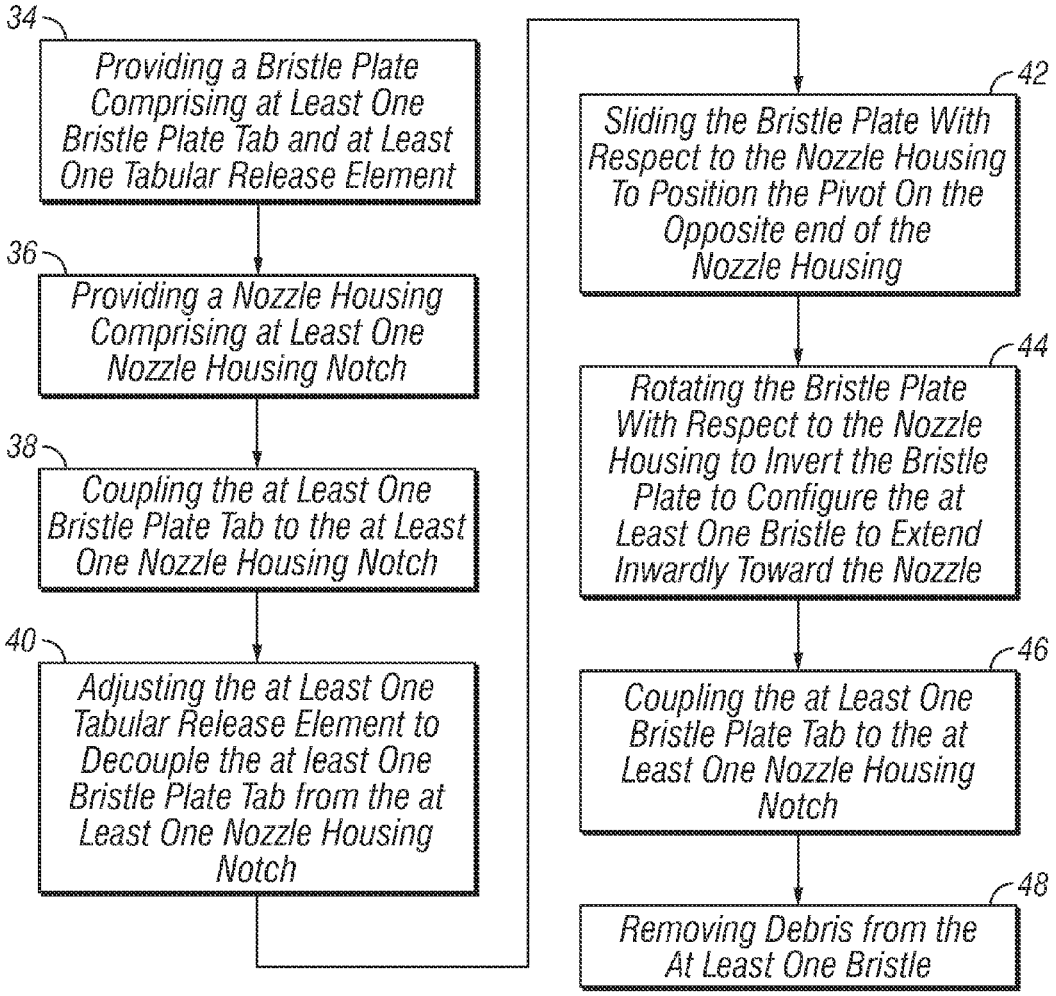
FIG. 5 illustrates a flow diagram depicting an exemplary method of making a self-cleaning vacuum cleaner accessory apparatus.

FIG. 5 is a flow diagram depicting an exemplary method of making a self-cleaning vacuum cleaner accessory apparatus. The method can include the step 34 of providing a bristle plate comprising at least one bristle plate tab and at least one tabular release element. The method can further include the step 36 of providing a nozzle housing comprising at least one nozzle housing notch. The method can further include the step 38 of coupling the at least one bristle plate tab to the at least one nozzle housing notch. The method can also include the step 40 of adjusting the at least one tabular release element to decouple the at least one bristle plate tab from the at least one nozzle housing notch.

The method can further include the step 42 of sliding the bristle plate with respect to the nozzle housing to position the pivot along the opposite end of the nozzle housing. The method can further include the step 44 of rotating the bristle plate with respect to the nozzle housing to invert the bristle plate to configure the at least one bristle to extend inwardly toward the nozzle. The method can further include the step 46 of coupling the at least one bristle plate tab to the at least one nozzle housing notch. The method can also include the step 48 of removing debris from the bristles. In one embodiment, the step 48 of removing debris from the bristles can include using the airflow from a vacuum in order to remove pet hair, fur, or the like from the bristles without the user having to touch the at least one bristle.

Figure 6:
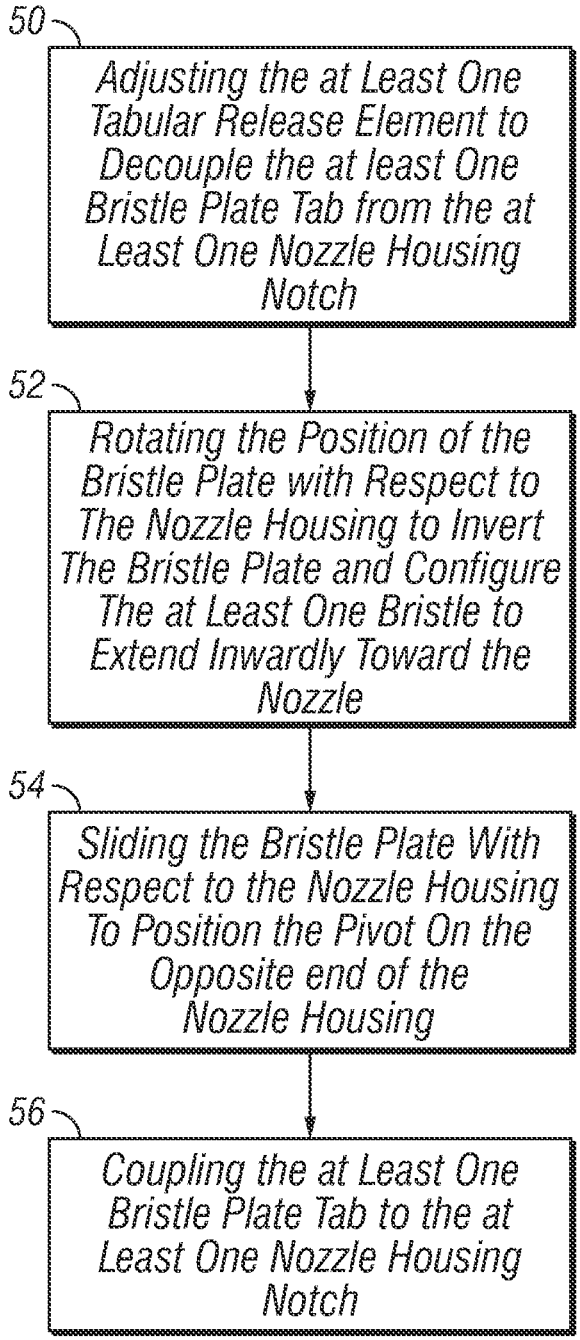
FIG. 6 illustrates a flow diagram depicting an exemplary method of restoring a self-cleaning vacuum cleaner accessory apparatus to its original configuration.

FIG. 6 is a flow diagram depicting an exemplary method of restoring a self-cleaning vacuum cleaner accessory apparatus to its original configuration. The method can include a step 50 of adjusting the at least one tabular release element to decouple the at least one bristle plate tab from the at least one nozzle housing notch. The method can also include the step 52 of rotating the bristle plate with respect to the nozzle housing to invert the bristle plate to configure the at least one bristle to extend outwardly from the nozzle. The method can further include the step 54 of sliding the bristle plate with respect to the nozzle housing to position the pivot along the opposite end of the nozzle housing. The method can also include step 56 of coupling the at least one bristle plate tab the at least one nozzle housing notch.

Figure 7:
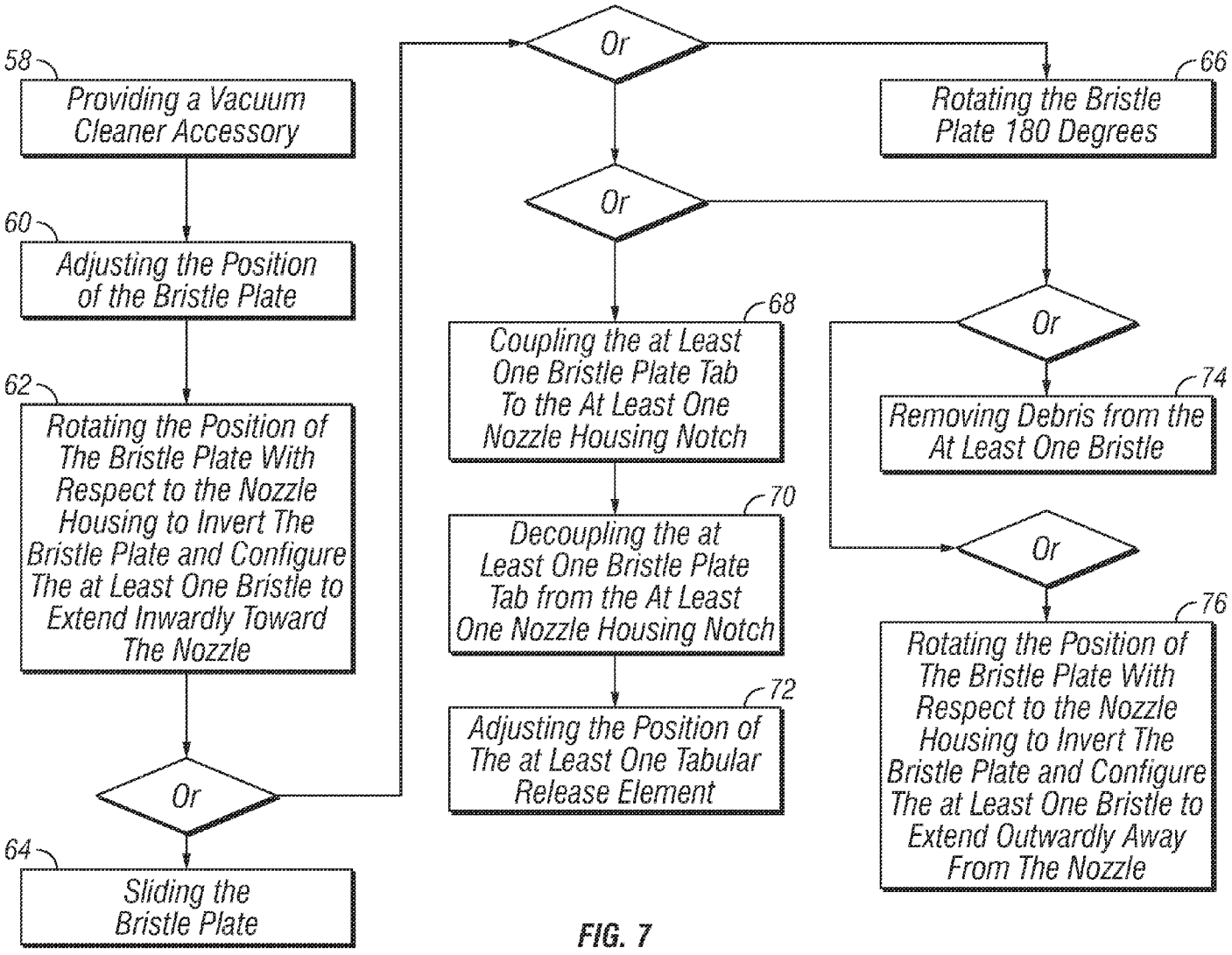
FIG. 7 illustrates a flow diagram depicting another exemplary method of making a self-cleaning vacuum cleaner accessory apparatus.

FIG. 7 is a flow diagram depicting another exemplary method of making a self-cleaning vacuum cleaner accessory apparatus (SCVCAA). The method can include the step 58 of providing a vacuum cleaner accessory that can include a nozzle, a nozzle housing, and at least one bristle that can extend outwardly from the nozzle. The bristle plate can further include a pivot. The disclosure can also include the step 60 that can include adjusting the position of the bristle plate with respect to the nozzle housing. The method can further include the step 62 of rotating the position of the bristle plate with respect to the nozzle housing to configure the at least one bristle to extend inwardly toward the nozzle.

In one embodiment, the method can include the step 64 of sliding the bristle plate away from the nozzle housing to an opposite edge of the nozzle housing along a horizontal axis of the nozzle housing. The method can further include the step 66 of rotating the bristle plate 180 degrees with respect to the nozzle housing in order to invert the at least one bristle's orientation with respect to the nozzle.

The disclosure can also include the step 68 of coupling the bristle plate tab to at least one nozzle housing notch. The method can further include the step 70 of decoupling the at least one bristle plate tab from the at least one nozzle housing notch in order permit the bristle plate's movement with respect to the nozzle housing. The decoupling step 70 can further include the step 72 of adjusting the position of at least one tabular release element. The method can further include the step 74 of removing debris from the at least one bristle. The method can also include the step 76 of rotating the position of the bristle plate with respect to the nozzle housing to configure the at least one bristle to extend outwardly from the nozzle. In one embodiment, the step 76 of rotating the position of the bristle plate can facilitate the process of restoring the self-cleaning vacuum cleaner accessory to its original configuration.

FIG. 8 is a front schematic view of a first embodiment of the self-cleaning vacuum cleaner accessory system 26. The self-cleaning vacuum cleaner accessory system 26 can include a vacuum hose 30 and a vacuum 28. The vacuum hose 30 can be operably connected to a vacuum inlet 32. The self-cleaning vacuum cleaner accessory system 26 can include a self-cleaning vacuum cleaner apparatus (SCVCAA) 2. The SCVCAA 2 can include a tubular element 4 and a nozzle 6. The tubular element 4 can be adapted for releasable attachment to, or detachment from, the vacuum 28. The nozzle 6 can be operably coupled to a nozzle housing 8. The SCVCAA 2 can also include a bristle plate 12 adapted to be coupled to the nozzle housing 8 to facilitate the bristle plate's 12 movement with respect to the nozzle housing 8. The bristle plate 12 can include at least one bristle 10. The bristle plate 12 can further include a pivot 16. The at least one bristle 10 can be configured to extend outwardly from the nozzle 6.

In one exemplary and non-limiting illustrative embodiment, the self-cleaning vacuum cleaner accessory 2 can be made of injection-molded plastic, such as polypropylene, polyethylene, ABS, thermoplastics, polymerizing resin, polyacetal, polystyrene, and/or similar materials, with or without filling additives like fibers, chalks, or other flowable and settlable materials that may be injection-molded, cast, or low-pressure molded, in accordance with conventional practice. Furthermore, nozzle housing 8, the bristle plate 12 and the pivot 16 can be assembled without the use of tools. For example, in one exemplary and non-limiting illustrative embodiment, each of the nozzle housing 8, the bristle plate 12 and the pivot 16 can be assembled by way of a snap together design.

The term "coupled," "coupling," "coupler," and like terms are used broadly herein and can include any method or device for securing, binding, bonding, fastening, attaching, joining, inserting therein, forming thereon or therein, or otherwise associating, for example, mechanically, magnetically, electrically, chemically, operably, directly or indirectly with intermediate elements, one or more pieces of members together and can further include without limitation integrally forming one functional member with another in a unitary fashion. The coupling can occur in any direction, including rotationally.

The Figures described above and the written description of specific structures and functions above are not presented to limit the scope of what Applicant has invented or the scope of the appended claims. Rather, the Figures and written description are provided to teach any person skilled in the art to make and use the invention for which patent protection is sought. Those skilled in the art will appreciate that not all features of a commercial embodiment of the invention is described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions can include, and likely are not limited to, compliance with system-related, business-related, government-related and other constraints, which can vary by specific implementation, location and from time to time. While a developer's efforts might be complex and time-consuming in an absolute sense, such efforts would be, nevertheless, a routine undertaking for those of skill this art having benefit of this disclosure. It must be understood that the invention disclosed and taught herein is susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Likewise, discussion of singular elements or components can include plural elements or components, and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

In some alternate implementations, the functions/actions/structures noted in the Figures can occur out of the order noted in the block diagrams and/or operational illustrations. For example, two operations shown as occurring in succession, in fact, can be executed substantially concurrently or the operations can be executed in the reverse order, depending upon the functionality/acts/structure involved. Furthermore, although FIG. 7 illustrates one possible embodiment of a method of making a self-cleaning vacuum cleaner accessory apparatus, several other embodiments have been contemplated as well. For example, FIG. 7 recites the step 60 of adjusting the position of the bristle plate before the step 70 of decoupling the at least one bristle plate tab from the at least one nozzle housing notch. Other embodiments can include performing step 70 before step 60. In some embodiments, some steps can be omitted altogether. Therefore, though not explicitly illustrated in the Figures, any and all combinations or sub-combinations of the steps illustrated in FIG. 7, or additional steps described in the Figures or the detailed described provided herein, can be performed in any order, with or without regard for performing the other recited steps.

Those of skill in the art should, in light of the present disclosure, appreciate that many changes can be made in the specific embodiments which are disclosed and still obtain a like or similar result without departing from the scope of the invention.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A self-cleaning vacuum cleaner accessory apparatus, comprising:

a tubular element adapted for releasable attachment or detachment with a vacuum;

a nozzle housing;

a nozzle, wherein the nozzle is operably coupled to the nozzle housing;

a bristle plate comprising a pivot, wherein the bristle plate is adapted to be coupled to the nozzle housing to facilitate the bristle plate's movement with respect to the nozzle housing; and at least one bristle extending outwardly from the nozzle, wherein the bristle plate is adapted to slide away from the nozzle housing.

2. The vacuum cleaner accessory apparatus of claim 1, wherein the bristle plate is adapted to slide away from the nozzle housing along a horizontal axis of the nozzle housing.

3. The vacuum cleaner accessory apparatus of claim 2, wherein the bristle plate is adapted to slide to an opposite end of the nozzle housing.

4. The vacuum cleaner accessory apparatus of claim 1, wherein the bristle plate further comprises at least one bristle plate tab adapted to be coupled to at least one nozzle housing notch.

5. The vacuum cleaner accessory apparatus of claim 4, wherein the bristle plate further comprises at least one tabular release element, wherein the at least one tabular release element is adapted to control the movement of the at least one bristle plate tab.

6. The vacuum cleaner accessory apparatus of claim 5, wherein the at least one tabular release element is adapted to decouple the at least one bristle plate tab from the at least one nozzle housing notch to permit the bristle plate's movement with respect to the nozzle housing.

7. The vacuum cleaner accessory apparatus of claim 1, wherein the nozzle housing further comprises at least one nozzle housing notch adapted to receive at least one bristle plate tab.

8. The vacuum cleaner accessory apparatus of claim 7, wherein the at least one bristle plate tab is operably coupled to the at least one nozzle housing notch to prohibit the bristle plate's movement with respect to the nozzle housing.

9. The vacuum cleaner accessory apparatus of claim 1, wherein the pivot is adapted to rotate the position of the bristle plate with respect to the nozzle housing.

10. The vacuum cleaner accessory apparatus of claim 9, wherein the pivot is adapted to rotate the position of the bristle plate to configure the at least one bristle to extend inwardly toward the nozzle.

11. A method a making a self-cleaning vacuum cleaner accessory apparatus, the method comprising:

providing a vacuum cleaner accessory, comprising:

a nozzle;

a nozzle housing;

a bristle plate comprising a pivot; and at least one bristle extending outwardly from the nozzle;

adjusting the position of the bristle plate with respect to the nozzle housing; and rotating the position of the bristle plate with respect to the nozzle housing to configure the at least one bristle to extend inwardly toward the nozzle, wherein the adjusting step comprises sliding the pivot to an opposite edge of the nozzle housing along a horizontal axis of the nozzle housing.

12. The method of making a self-cleaning vacuum cleaner accessory apparatus of claim 11, wherein the rotating step comprises rotating the bristle plate 180 degrees with respect to the nozzle housing.

13. The method of making a self-cleaning vacuum cleaner accessory apparatus of claim 11, further comprising the step of coupling at least one bristle plate tab to at least one nozzle housing notch.

14. The method of making a self-cleaning vacuum cleaner accessory apparatus of claim 13, further comprising the step of decoupling the at least one bristle plate tab from the at least one nozzle housing notch in order to permit the bristle plate's movement with respect to the nozzle housing.

15. The method of making the self-cleaning vacuum cleaner accessory apparatus of claim 14, wherein the decoupling step is performed by adjusting the position of at least one tabular release element.

16. The method of making a self-cleaning vacuum cleaner accessory apparatus of claim 11, further comprising the step of removing debris from the at least one bristle.

17. The method of making a self-cleaning vacuum cleaner accessory apparatus of claim 11, further comprising the step of rotating the position of the bristle plate with respect to the nozzle housing to configure the at least one bristle to extend outwardly away from the nozzle.

18. A self-cleaning vacuum cleaner accessory system, comprising:

a vacuum;

a vacuum hose;

a vacuum inlet;

a vacuum cleaner accessory apparatus, the accessory apparatus further comprising:

a tubular element, wherein the tubular element is adapted to be coupled to the vacuum;

a nozzle housing;

a nozzle, wherein the nozzle is operably coupled to the nozzle housing;

a bristle plate comprising a pivot, wherein the bristle plate comprises at least one bristle and the bristle plate is adapted to be coupled to the nozzle housing and is adapted to slide away from the nozzle housing; and at least one bristle extending outwardly from the nozzle.

* * * * *